US008951026B2

(12) United States Patent
Mohamed

(10) Patent No.: US 8,951,026 B2
(45) Date of Patent: Feb. 10, 2015

(54) POPPET VALVE ASSEMBLY

(71) Applicant: Cameron International Corporation, Houston, TX (US)

(72) Inventor: Zahroof Mohamed, Cypress, TX (US)

(73) Assignee: GE Oil & Gas Compression Systems, LLC, Houston, TX (US)

( * ) Notice: Subject to any disclaimer, the term of this patent is extended or adjusted under 35 U.S.C. 154(b) by 0 days.

(21) Appl. No.: 13/802,634

(22) Filed: Mar. 13, 2013

(65) Prior Publication Data

US 2013/0195703 A1 Aug. 1, 2013

Related U.S. Application Data

(63) Continuation of application No. 12/525,815, filed as application No. PCT/US2008/053239 on Feb. 6, 2008, now Pat. No. 8,485,801.

(60) Provisional application No. 60/922,923, filed on Apr. 11, 2007.

(51) Int. Cl.

| | |
|---|---|
| ***F04B 39/10*** | (2006.01) |
| ***F04B 53/10*** | (2006.01) |
| ***F04B 53/12*** | (2006.01) |
| ***F01L 3/08*** | (2006.01) |
| *F01L 3/00* | (2006.01) |

(52) U.S. Cl.

CPC ..... *F04B 53/12* (2013.01); *F01L 3/085* (2013.01); *F04B 39/1013* (2013.01); *F01L 2003/25* (2013.01)

USPC ..... 417/569; 137/512.1

(58) Field of Classification Search

USPC ..... 137/512.1, 536, 541, 542, 512.15; 417/454, 559, 569, 566, 560, 561

See application file for complete search history.

(56) References Cited

U.S. PATENT DOCUMENTS

| | | | | |
|---|---|---|---|---|
| 1,049,719 | A * | 1/1913 | Hunter | 417/451 |
| 1,630,666 | A | 5/1927 | McEvoy | |
| 4,084,609 | A | 4/1978 | Johnson | |
| 4,756,674 | A * | 7/1988 | Miller | 417/534 |
| 4,766,927 | A | 8/1988 | Conatser | |
| 2001/0039966 | A1 * | 11/2001 | Walpole et al. | 137/512.1 |
| 2002/0020451 | A1 | 2/2002 | Reid et al. | |

FOREIGN PATENT DOCUMENTS

| | | |
|---|---|---|
| AU | 6306169 | 4/1971 |
| EP | 1555471 | 7/2005 |
| WO | WO2005114835 | 12/2005 |

OTHER PUBLICATIONS

PCT International Search Report and Written Opinion for PCT/US2008/53239, dated Jul. 28, 2008.

* cited by examiner

*Primary Examiner* — Bryan Lettman

(74) *Attorney, Agent, or Firm* — Fletcher Yoder, P.C.

(57) ABSTRACT

A novel valve assembly is provided. In one embodiment, the valve assembly includes a seat plate having a plurality of fluid conduits. The valve assembly may also include a plurality of poppet assemblies. In some embodiments, a poppet assembly of such a plurality includes at least one fluid port and a housing configured to be coupled to the seat plate to facilitate flow of a fluid through a respective fluid conduit via the at least one fluid port of the respective poppet assembly. Other devices, systems, and methods related to poppet assemblies are also disclosed.

21 Claims, 5 Drawing Sheets

POPPET VALVE ASSEMBLY

CROSS-REFERENCE TO RELATED APPLICATIONS

This application claims priority to U.S. Non-Provisional application Ser. No. 12/525,815 entitled "Poppet Valve Assembly", filed on Aug. 4, 2009, which is herein incorporated by reference in its entirety, and which claims priority to PCT Application No. PCT/US2008/053239 entitled "Poppet Valve Assembly", filed on Feb. 6, 2008, which is herein incorporated by reference in its entirety, and which claims priority to U.S. Provisional Patent Application No. 60/922,923, entitled "Poppet Valve Assembly", filed on Apr. 11, 2007, which is herein incorporated by reference in its entirety.

FIELD OF THE INVENTION

The present invention relates generally to valve assemblies. More particularly, the present invention relates to a novel poppet valve assembly for use with various flow control systems, including compression systems.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

As will be appreciated, fluids, such as natural gas and air, have a wide array of uses in industrial and commercial applications. For instance, natural gas may be used to provide power to a range of vehicles, to heat homes during winter, and to operate various consumer appliances, such as ovens or clothes dryers. Further, natural gas may be used to generate electricity for distribution over a power grid, and may be used in the manufacture of an array of products and materials, including glass, steel, and plastics, for example.

In order to meet the demand for natural gas, companies may spend a significant amount of time and resources searching for, extracting, and transporting natural gas. It will be appreciated that natural gas may be produced from oil fields, in which case the gas may be referred to as casinghead gas, or from natural gas fields. As may also be appreciated, transportation of such natural gas, such as through a pipeline from the production site to a consumer, is often facilitated by compression of the gas via a compressor.

One common type of compressor for such applications is the reciprocating compressor. Such reciprocating compressors are positive-displacement devices that generally utilize a crankshaft that is coupled to pistons, via connecting rods and crossheads, to reciprocally drive the pistons and compress a fluid within attached compression cylinders. As may be appreciated by one skilled in the art, natural gas (or some other fluid) is generally introduced into compression chambers of the cylinders through one or more inlet or suction valve assemblies and, following compression, the fluid generally exits the cylinders via one or more outlet or discharge valve assemblies.

Further, one common type of valve assembly is the poppet valve assembly, which traditionally includes a set of poppets disposed between a seat plate and a guard plate. As many compressors routinely operate at hundreds or thousands of rotations per minute (rpm), such poppets also open and close at a similarly high rate. Due to this rapid cycling, the seat plate, the guard plate, and/or the poppets will often wear over time, leading to valve failure if left unchecked. To avoid such failure, a typical, worn poppet valve assembly may need to be repaired or refurbished, such as through replacement of the poppets, machining or refinishing of the seat and/or guard plates, or the like. Of course, such maintenance is often time-consuming and/or costly. Consequently, there is a need for a poppet valve assembly that exhibits an increased durability and life expectancy, and that allows for easier, faster, and cheaper maintenance.

SUMMARY

Certain aspects commensurate in scope with the originally claimed invention are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Embodiments of the present invention generally relate to a novel poppet valve assembly. In some embodiments, the valve assembly includes a plurality of poppet assemblies that are attached to a common seat plate. In one embodiment, the plurality of poppet assemblies includes a plurality of individually-captured poppets. An exemplary poppet assembly of this embodiment may include a single poppet, one or more impact bushings, one or more biasing members, a housing, and a cover. As discussed in greater detail below, such an arrangement may allow individual replacement of components of the valve assembly in an efficient manner. Further, in some embodiments, the use of multiple poppet assemblies, instead of a guard plate that is common to all of the poppets, may promote more efficient flow of fluid through the valve assembly and reduce the clearance volume of a compressor cylinder in which the valve assembly is installed.

Various refinements of the features noted above may exist in relation to various aspects of the present invention. Further features may also be incorporated in these various aspects as well. These refinements and additional features may exist individually or in any combination. For instance, various features discussed below in relation to one or more of the illustrated embodiments may be incorporated into any of the above-described aspects of the present invention alone or in any combination. Again, the brief summary presented above is intended only to familiarize the reader with certain aspects and contexts of the present invention without limitation to the claimed subject matter.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF SPECIFIC EMBODIMENTS

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

Figure 1:
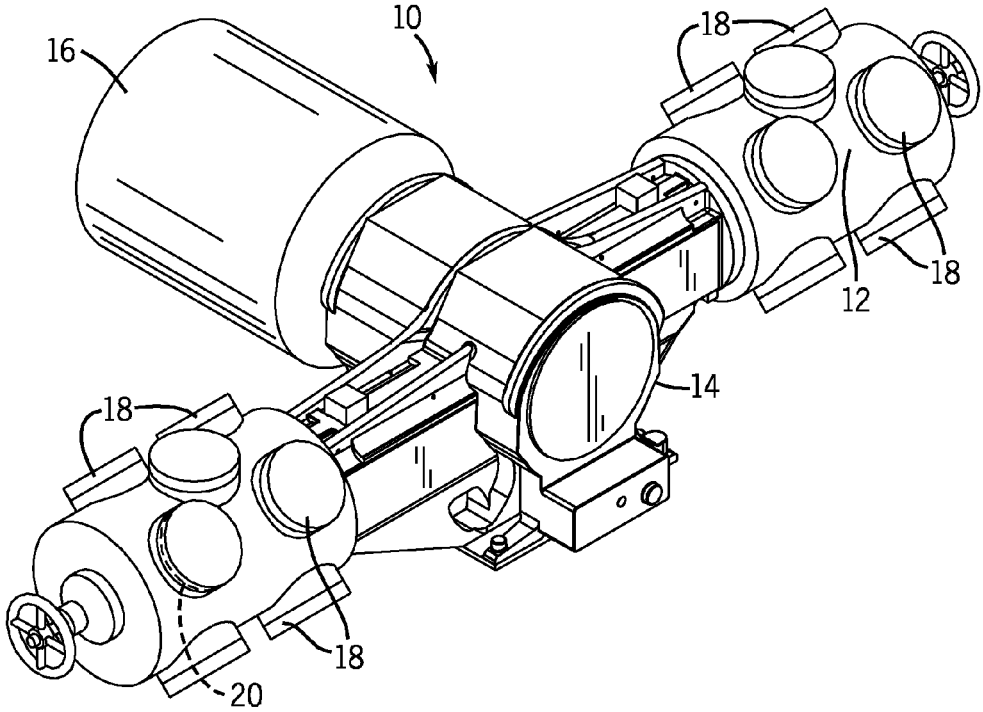
FIG. 1 is a perspective view of a reciprocating compressor including an exemplary valve assembly in accordance with one embodiment of the present invention.

Turning now to the figures, an exemplary compressor 10 is provided in FIG. 1. In the presently illustrated embodiment, the compressor 10 includes a pair of compression cylinders 12 coupled to a frame 14. As discussed in greater detail below, a variety of internal components may be disposed within the cylinders 12 and the frame 14 to enable compression of fluids within the cylinders 12. In one embodiment, the compressor 10 may be utilized to compress natural gas. However, in other embodiments, the compressor 10 may be configured and/or utilized to compress other fluids. A mechanical power source or driver 16, such as an engine or an electric motor, may be coupled to the compressor 10 to provide mechanical power to the various internal components and to enable compression of the fluid within the cylinders 12. To facilitate access to such internal components, as may be desired for diagnostic or maintenance purposes, openings in the frame 14 may be provided and selectively accessed via removable covers disposed over the openings.

Further, the exemplary cylinders 12 include capped recesses 18 configured to receive valve assemblies, such as valve assembly 20. While only a single valve assembly 20 is illustrated, it will be appreciated that, in various embodiments, additional valve assemblies are included within some or all of the other capped recesses 18. It will also be appreciated that the cylinders 12 may include internal fluid conduits between the recesses 18 and the valve assemblies 20 to facilitate flow of a fluid into and out of the cylinders 12 through such valve assemblies. Additionally, various installation components, such as cages or fasteners, may be employed to facilitate mounting of the valve assemblies 20 within the recesses 18.

Although the exemplary compressor 10 is illustrated as a two-throw reciprocating compressor, other compressor configurations may also employ and benefit from the presently disclosed techniques. For instance, in other embodiments, the compressor 10 may include a different number of cylinder throws, such as a four-throw compressor, a six-throw compressor, a couple-free reciprocating compressor, a screw compressor, or the like. Further, other variations are also envisaged, including variations in the length of stroke, the operating speed, and the size, to name but a few.

Figure 2:
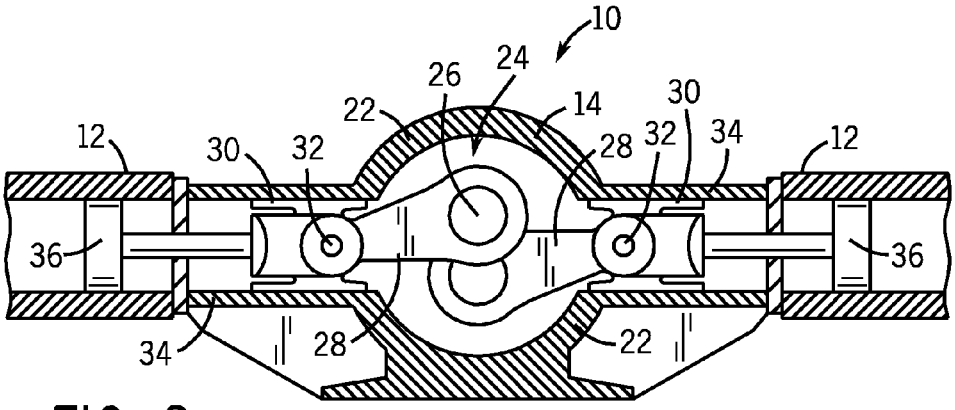
FIG. 2 is an axial cross-sectional view of the exemplary compressor of FIG. 1, illustrating internal components of the compressor in accordance with one embodiment of the present invention.

A cross-sectional view of the exemplary compressor 10 is provided in FIG. 2, which illustrates a number of exemplary internal components of the compressor of FIG. 1. In the presently illustrated embodiment, the frame 14 of the exemplary compressor 10 includes a hollow central body or housing 22 that generally defines an interior volume 24 in which various internal components may be received, such as a crankshaft 26. In one embodiment, the central body 22 may have a generally curved or cylindrical shape. It should be noted, however, that the central body 22 may have other shapes or configurations in full accordance with the present techniques.

In operation, the driver 16 rotates the crankshaft 26 supported within the interior volume 24 of the frame 14. In one embodiment, the crankshaft 26 is coupled to crossheads 30 via connecting rods 28 and pins 32. The crossheads 30 are disposed within crosshead guides 34, which generally extend from the central body 22 and facilitate connection of the cylinders 12 to the compressor 10. In one embodiment, the compressor 10 includes two crosshead guides 34 that extend generally perpendicularly from opposite sides of the central body or housing 22, although other configurations are also envisaged. As may be appreciated, the rotational motion of the crankshaft 26 is translated via the connecting rods 28 to reciprocal linear motion of the crossheads 30 within the crosshead guides 34.

As noted above, the cylinders 12 are configured to receive a fluid for compression. The crossheads 32 are coupled to pistons 36 disposed within internal compression chambers of the cylinders 12, and the reciprocating motion of the crossheads allows compression of fluid within the compression chambers via the pistons 36. Particularly, as a piston 36 is driven forward (i.e., outwardly from central body 22) into a cylinder 12, the piston 36 forces fluid within the cylinder into a smaller volume, thereby increasing the pressure of the fluid. A discharge valve, such as valve assembly 20, may then open to allow the pressurized or compressed fluid to exit the cylinder 12. The piston 36 may then stroke backward, and additional fluid may enter the cylinder 12 through an inlet valve, which may also comprise a valve assembly 20, for compression in the same manner described above. Further, as will be appreciated, the cylinders 12 can be configured to facilitate fluid compression on both the forward and the backward strokes of the piston 36. For instance, as the piston 36 moves forward in the manner discussed above to compress fluid on one side of the piston, additional fluid may be introduced into the cylinder on the opposite side of the piston. Such fluid would then be compressed on the backward stroke of the piston 36.

Figure 3:
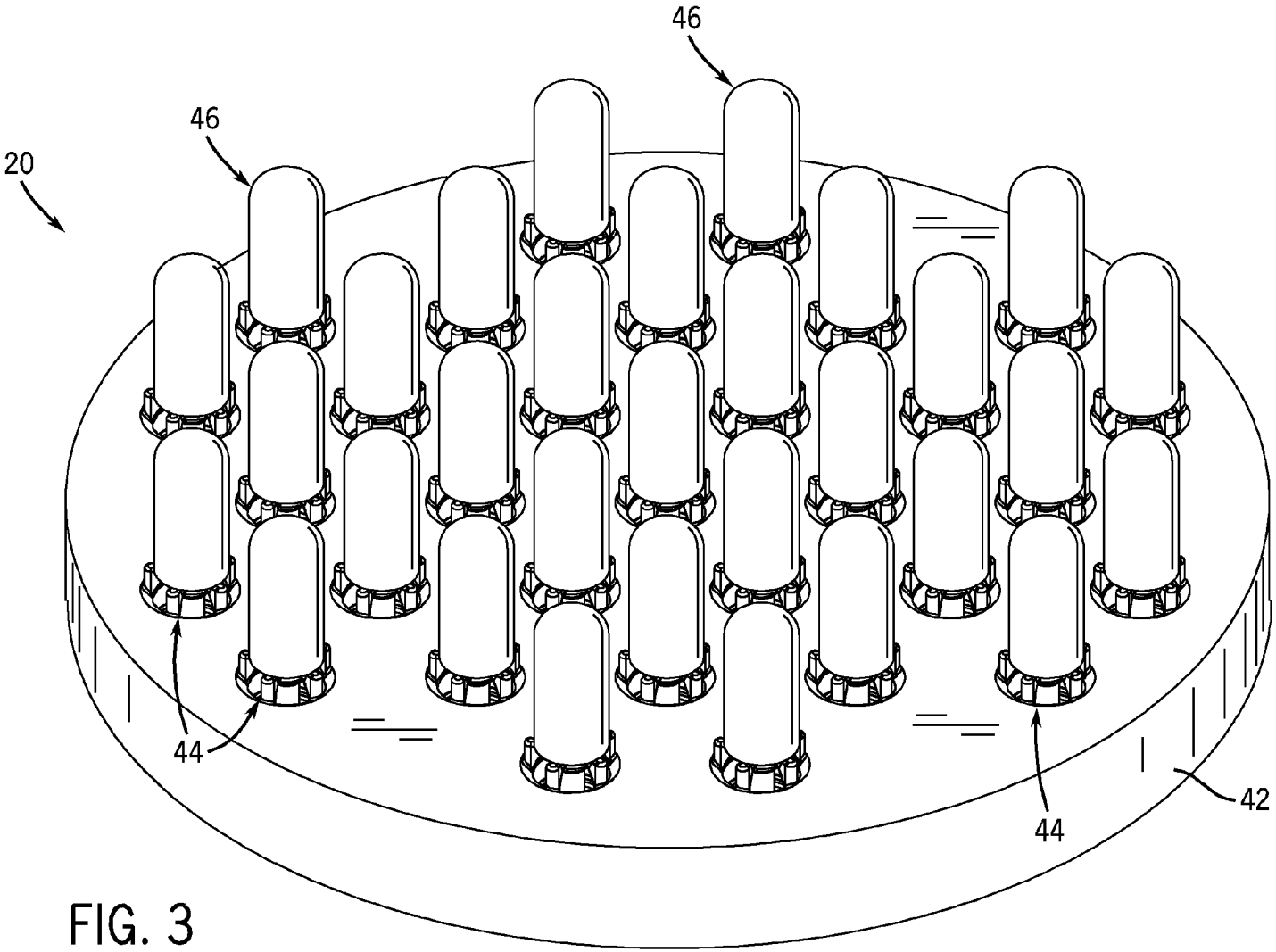
FIG. 3 is a perspective view of an exemplary valve assembly in accordance with one embodiment of the present invention.
Figure 4:
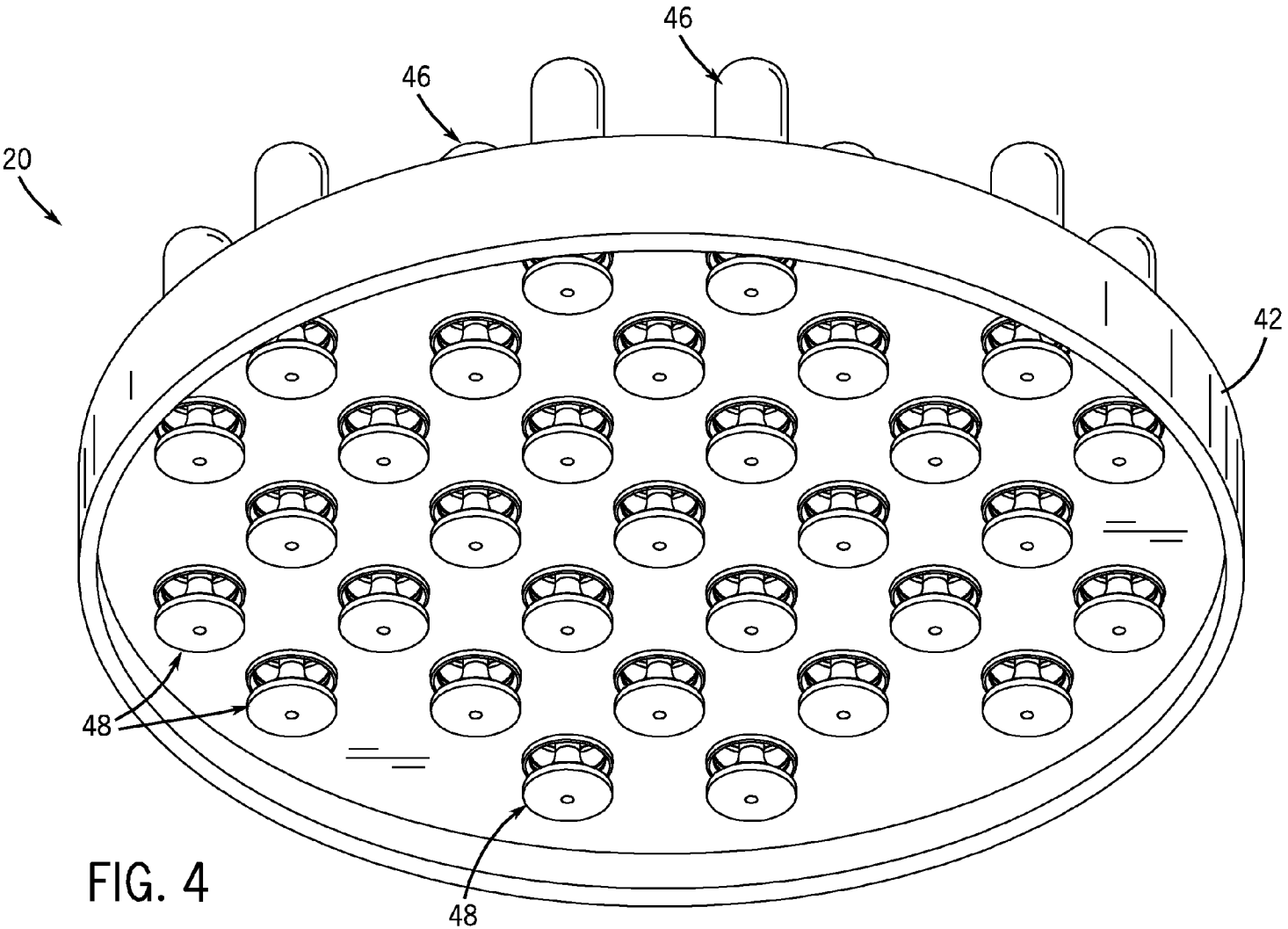
FIG. 4 is an additional perspective view of the valve assembly of FIG. 3.

Upper and lower perspective views of an exemplary valve assembly 20 are respectively provided in FIGS. 3 and 4. In this embodiment, the valve assembly 20 includes a seat plate 42 having a number of fluid ports or conduits 44, which allow a fluid, such as natural gas, to flow through the valve assembly 20. The seat plate 42 is formed from metal, or some other suitable high-strength material. As discussed in greater detail below, the exemplary valve assembly 20 also includes a plurality of poppet assemblies 46 coupled to the seat plate 42. In some embodiments, the poppet assemblies 46 generally extend from a first side of the seat plate 42, and include poppets 48 that selectively control the flow of a fluid through the fluid ports 44 at a second side of the seat plate 42 opposite the first side, as generally illustrated in FIGS. 3 and 4, and as discussed in greater detail below. In one embodiment, the poppets 48 are formed from plastic, although other materials, such as metal or ceramic, may be utilized in full accordance with the present techniques.

Figure 7:
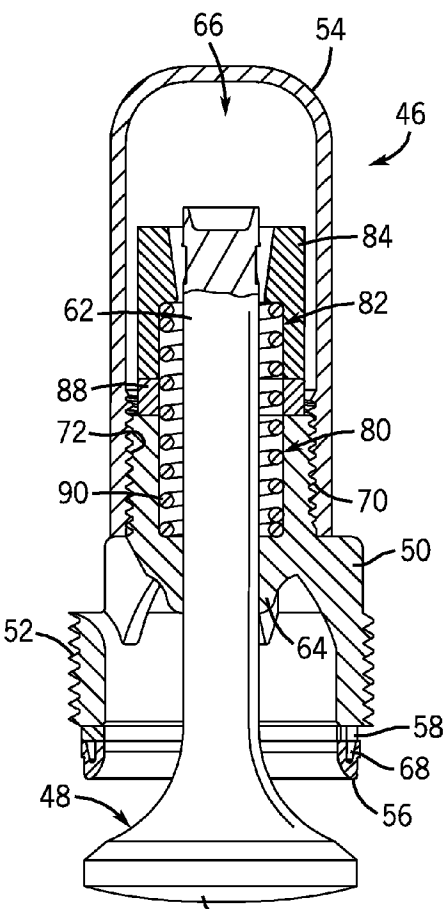
FIG. 7 is a partial cross-sectional view of the poppet assembly of FIG. 5 in accordance with one embodiment of the present invention.
Figure 6:
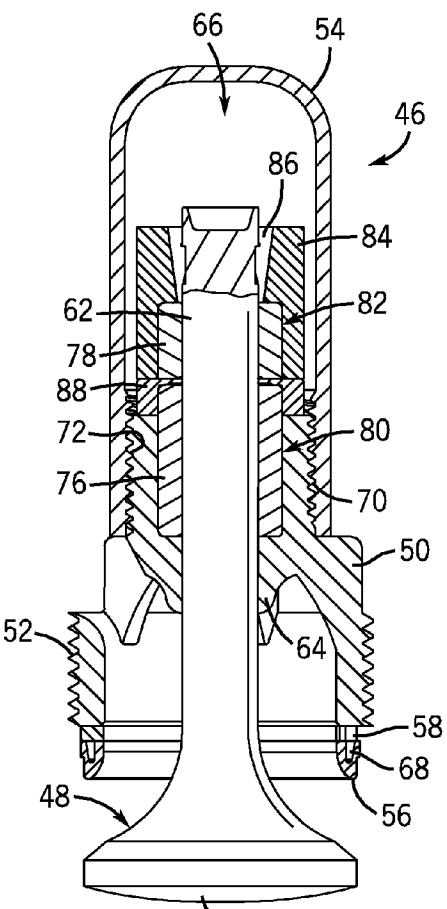
FIG. 6 is a partial cross-sectional view of the poppet assembly of FIG. 5, depicting internal components of the poppet assembly in accordance with one embodiment of the present invention.
Figure 5:
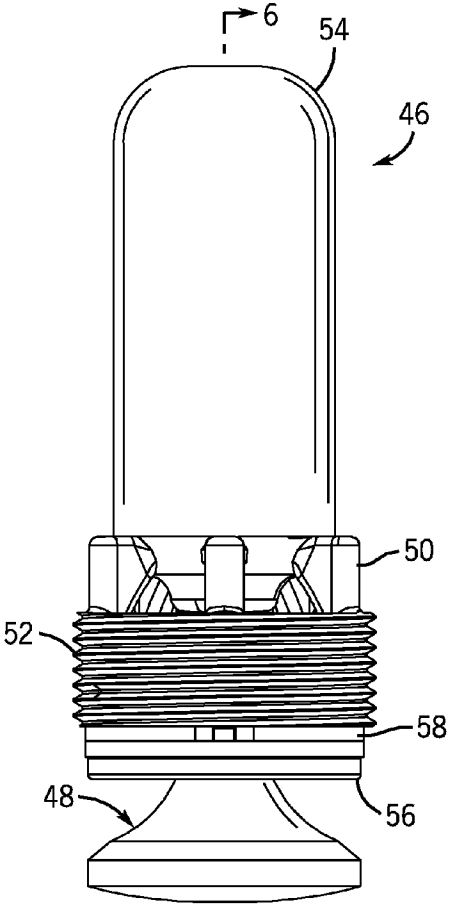
FIG. 5 is an elevational view of an exemplary poppet assembly of the valve assembly of FIGS. 3 and 4 in accordance with one embodiment of the present invention.

Additional features of the poppet assemblies 46 of certain embodiments may be better understood with reference to FIGS. 5-7. Particularly, FIG. 5 is a front elevational view of an exemplary poppet assembly 46, while FIGS. 6 and 7 illustrate various internal components of the poppet assembly 46. As illustrated in FIG. 5, the poppet assembly 46 includes a housing 50 having a mounting portion, such as a threaded surface 52. In some embodiments, including those illustrated in FIGS. 5-7, for example, housing 50 is configured to receive only a single poppet 48. In other embodiments, however, the housing 50 may receive multiple poppets 48.

The poppet assembly 46 may also include an impact bushing 56 coupled to the housing 50. In such an embodiment, the poppet 48 may open and close against the impact bushing 56 to selectively control flow of a fluid through the housing 50. In certain embodiments, the impact bushing 56 may be coupled to the housing 50 via one or more spacers 58. A spacer 58 may, in some embodiments, be split to facilitate assembly of the components. Further, the impact bushing 56 may also include one or more recesses or grooves 68 to facilitate sealing of the impact bushing 56 with the seat plate 42. It should be noted that the housing 50, the impact bushing 56, and the one or more spacers 58 may be formed from any number of suitable materials, including a variety of plastics and/or metals. For instance, in one embodiment, the housing 50 is formed of metal, while the impact bushing 56 and a spacer 58 are made from one or more plastics. Further, it will be appreciated that these components may be formed through any suitable manufacturing process.

As may be seen in FIGS. 6 and 7, the exemplary poppet 48 includes a poppet head 60 that opens and closes against the impact bushing 56, as discussed above, and a poppet stem 62, which is disposed in a receiving portion 64 of the housing 50 and extends into an interior region or volume 66 generally defined by the housing 50 and a cap or cover 54. In one embodiment, the cover 54 is formed of plastic, although other materials may be used in accordance with the present techniques. The cover 54 may be removably coupled to the housing 50 to enclose a variety of internal components of the poppet assembly 46. For instance, in some embodiments, the cover 54 includes a threaded surface 70 that cooperates with a complementary surface 72 of the housing 50, allowing the cover 54 to be screwed to, and unscrewed from, the housing 50. In addition to the stem 62, other components that may also be disposed within the interior region 66 include actuating elements or biasing members. The cover 54 and the housing 50 cooperate to isolate the components disposed within the interior region 66 from the fluid flowing through the valve assembly 20, and these components are generally protected from particles in the fluid stream. Further, when used as an inlet valve member for a compression cylinder, the housing 50, the cover 54, and the components within the internal region 66 poppet assembly 46 are generally disposed upstream from the sealing surfaces (the poppet head 60 and the impact bushing 56, for instance) and are isolated and generally protected from high temperatures and pressures within the compression chamber (downstream of the poppet head 60) during operation.

As will be appreciated, a poppet valve generally includes one or more of such biasing members configured to apply a biasing force to a poppet. In some embodiments, such as that illustrated in FIG. 6, the poppet assembly 46 includes biasing magnets 76 and 78 disposed in recesses 80 and 82 of the housing 50 and a carrier 84, respectively. The carrier 84 may be coupled to the stem 62 via one or more shims or tapered members 86. In this arrangement, the carrier assembly coupled to the stem 62 (including the magnet 78 and the carrier 84) will undergo reciprocal motion with the poppet 48 during operation of the poppet assembly 46, as discussed below. Additionally, in some embodiments, an impact bushing 88, which may be formed from plastic or any other suitable material, is disposed between the housing 50 and the carrier 84, and may reduce wear on these components. It should be noted that, while the poppet assembly 46 may be magnetically-actuated in some embodiments, a spring 90 may be used in other embodiments in addition to, or in place of, the magnets 76 and 78, as generally illustrated in FIG. 7.

Advantageously, in the presently illustrated embodiments, the poppet assembly 46 is configured to facilitate efficient servicing of one or more of the components of the assembly. Notably, the presently disclosed embodiment allows for many of the components of the poppet assembly 46, including the poppet 48, the housing 50, the cover 54, the impact bushing 56, and various internal components, to be replaced individually, without requiring replacement of the entire poppet assembly 46. For instance, over time, one or both of the impact bushings 56 and 88 may exhibit wear from repeated contact with the poppet 48. In such a case, the individual poppet assembly 46 may be removed from the seat plate 42, the poppet 48 and worn impact bushings 56 and/or 88 may be removed from the housing 50, and the poppet 48 may be reinstalled with new impact bushings 56 and/or 88. Further, in some embodiments, because a seal is formed between the poppet 48 and the impact bushing 56, the inclusion of an impact bushing 56 reduces or eliminates the need to finish (or refinish) the seat plate 42 in order to facilitate sealing of the seat plate 42 directly with the poppet 48. The refurbished poppet assembly 46 may then be reattached to the seat plate 42 and the valve assembly 20 may be placed back into service. Also, in some embodiments, the seat plate 42 includes a threaded surface 92 (FIG. 8) that cooperates with the threaded surface 52 of the housing 50 to facilitate simple attachment and removal of the poppet assembly 46 from the seat plate 42, further enhancing the ease with which the valve assembly 20 may be assembled and maintained.

It should also be noted that while certain embodiments of the valve assembly 20 may comprise the seat plate 42 and one or more poppet assemblies 46 in addition to other components, other embodiments in accordance with the present techniques may consist of, or consist essentially of, the seat plate 42 and the one or more poppet assemblies 46. Similarly, while a poppet assembly 46 of some embodiments may comprise other components in addition to the poppet 48, the housing 50, the cover 54, the impact bushings 56 and 88, the spacer 58, and the other internal elements explicitly discussed above, in other embodiments the poppet assembly 46 consists of, or consists essentially of, these elements or some subcombination thereof. Further, while certain embodiments of the valve assembly 20 include a plurality of poppet assemblies 46, it should be noted that other embodiments may instead include only a single poppet assembly 46 in full accordance with the present techniques.

Figure 9:
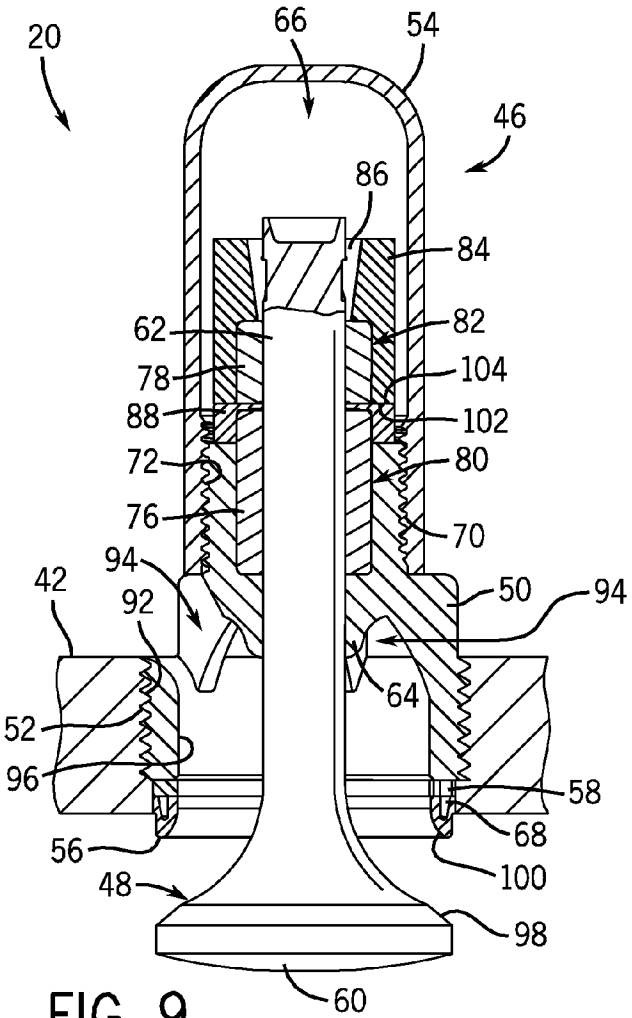
FIG. 9 is a partial cross-sectional view of the exemplary valve assembly illustrated in FIG. 8, depicting the poppet in an open position in accordance with one embodiment of the present invention.
Figure 8:
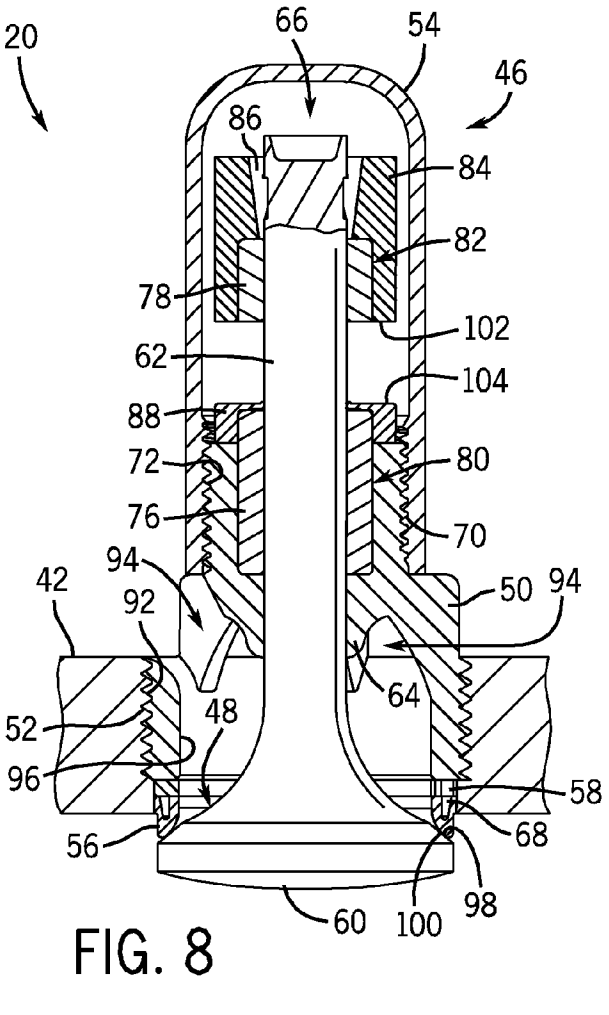
FIG. 8 is a partial cross-sectional view of the exemplary valve assembly of FIGS. 3 and 4, illustrating various internal components of the valve assembly, including a poppet oriented in a closed position in accordance with one embodiment of the present invention.

Additional features of an exemplary valve assembly 20 are illustrated in the cross-sectional views of FIGS. 8 and 9. In the presently illustrated embodiment, a poppet assembly 46 is coupled to a fluid port 44 of the seat plate 42 via the threaded surfaces 52 and 92, as discussed above. Other or additional attachment mechanisms, however, could be provided in full accordance with the present techniques. For instance, in various embodiments, the seat plate 42 may include externally threaded extensions configured to receive internally threaded mounting portions of housings 50, the housings 50 may be coupled to the seat plate 42 via a fastener, or the like. Additionally, while the mounting portion of the housing 50 is directly coupled to the seat plate 42 in certain embodiments, the mounting portion of the housing may be coupled to the seat plate 42 via one or more intermediate members, such as a nipple fitting, in other embodiments.

In operation, the magnets 76 and 78 are positioned to repel one another and to generally apply a force on the poppet 48 that biases the poppet head 60 toward the housing 50. However, an opposing force will be applied to the poppet 48 when the pressure above the poppet head 60 (e.g., the region generally defined by a bore 96 of the housing 50) exceeds the pressure in the region immediately below the poppet head 60. As will be appreciated, when the biasing force is greater than the opposing force, an upper surface 98 of the poppet head 60 will generally engage a complimentary surface 100 of the impact bushing 56 to form a seal between these two surfaces, as illustrated in FIG. 8. It should be noted, however, that the upper surface 98 may instead impact and seal against some other surface of the poppet assembly 46, such as the housing 50, in other embodiments.

Upon a sufficient pressure differential between the region within the bore 96 and the region below the poppet head 60, the opposing force resulting from such pressure differential will exceed the biasing force applied by the magnets 76 and 78 (or the spring 90), as well as any frictional forces, causing the poppet 48 to move into the open position illustrated in FIG. 9. In this position, the opening of the poppet head 60 with respect to the seat plate 42 enables fluid to flow from the side of the seat plate 42 from which the poppet assemblies 46 generally extend, through fluid ports 94 of the housing 50 into the bore 96 of the housing 50, to the opposite side of the seat plate 42 and past the poppet head 60. When fully open, a lower surface 102 of the carrier 84 may abut an upper surface 104 of the impact bushing 88.

It should also be noted that, in some embodiments, the use of poppet assemblies 46 with the seat plate 42 allows the valve assembly 20 to be assembled and operated without a guard plate, further reducing the manufacturing and maintenance costs of such valve assemblies 20. Additionally, it will be appreciated that the exclusion of a conventional guard plate may also reduce the manufacturing cost associated with production of the seat plate 42, such as by eliminating the need to machine the seat plate 42 for coupling to the guard plate. Still further, in a traditional poppet valve assembly, the guard plate has a number of fluid ports that allow fluid to flow through the guard plate. The body of the guard plate in the traditional poppet valve assembly, however, somewhat impedes such flow, as fluid can only pass through the body via the fluid ports. Conversely, in some embodiments of the present invention, the use of individual poppet assemblies 46, rather than a conventional guard plate, reduces the amount of material impeding the flow of fluid through the valve assembly 20, and results in lower resistance and higher efficiency than conventional poppet valve assemblies.

Further yet, in one embodiment in which a valve assembly 20 is positioned as an inlet valve assembly of the cylinder 12, the clearance volume of the cylinder 12 may be reduced in comparison to traditional poppet valve assemblies that include a guard plate, thereby increasing the volumetric efficiency of the cylinder 12. More particularly, when a traditional poppet valve assembly having a guard plate is used as an inlet valve for a cylinder 12, fluid ports in the guard plate below the poppets of the traditional assembly add to the clearance volume of the cylinder (generally the volume of the cylinder between the seals of the inlet and outlet valve(s) that is not traversed by the compression element), as the piston 36 generally extends through a compression chamber of the cylinder 12, and does not enter the fluid ports of the guard plate. In one embodiment in which a valve assembly 20 is disposed within a cylinder as an inlet valve, however, the omission of a guard plate and the orientation of the poppet heads 60 on a downstream side of the seat plate 42, along with the positioning of a substantial portion of the poppet assembly 46 (including the biasing mechanism) upstream of the poppet heads 60 and/or the seat plate 42, provides a reduction in the clearance volume and a corresponding increase in volumetric efficiency of the cylinder.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

a compressor having at least one compression chamber;

a first seat plate coupled to the at least one compression chamber, wherein the first seat plate comprises:

a plurality of first fluid conduits; and a plurality of first poppet assemblies, wherein each of the first poppet assemblies of the plurality of first poppet assemblies includes one or more first fluid ports and a first housing configured to be coupled to the first seat plate proximate a respective first fluid conduit of the plurality of first fluid conduits to facilitate flow of a first fluid through the first fluid conduit via the one or more first fluid ports of the respective first poppet assembly; and a second seat plate coupled to the at least one compression chamber, wherein the second seat plate comprises:

a plurality of second fluid conduits; and a plurality of second poppet assemblies, wherein each of the second poppet assemblies of the plurality of second poppet assemblies includes one or more second fluid ports and a second housing configured to be coupled to the second seat plate proximate a respective second fluid conduit of the plurality of second fluid conduits to facilitate flow of a second fluid through the second fluid conduit via the one or more second fluid ports of the respective second poppet assembly.

2. The system of claim 1, wherein the first housing of each first poppet assembly is configured to be directly coupled to a first internal bore of the first seat plate that generally defines at least one first fluid conduit of the plurality of first fluid conduits, wherein the second housing of each second poppet assembly is configured to be directly coupled to a second internal bore of the second seat plate that generally defines at least one second fluid conduit of the plurality of second fluid conduits.

3. The system of claim 2, wherein the first internal bore and the first housing comprise first mating threaded surfaces to facilitate coupling of the first housing to the first internal bore, wherein the second internal bore and the second housing comprise second mating threaded surfaces to facilitate coupling of the second housing to the second internal bore.

4. The system of claim 1, wherein each of the first poppet assemblies of the plurality of first poppet assemblies includes a first poppet, wherein each of the second poppet assemblies of the plurality of second poppet assemblies includes a second poppet.

5. The system of claim 4, wherein the first poppet of each first poppet assembly comprises a first stem received by the first housing and a first poppet head, wherein the second poppet of each second poppet assembly comprises a second stem received by the second housing and a second poppet head.

6. The system of claim 5, wherein at least one first poppet assembly of the plurality of first poppet assemblies is coupled proximate its respective first fluid conduit of the first seat plate such that the first stem of the first poppet extends substantially through the respective first fluid conduit, wherein at least one second poppet assembly of the plurality of second poppet assemblies is coupled proximate its respective second fluid conduit of the second seat plate such that the second stem of the second poppet extends substantially through the respective second fluid conduit.

7. The system of claim 6, comprising a first cover removably coupled to the at least one first poppet assembly, wherein the first cover cooperates with the first housing of the at least one first poppet assembly to generally define a first interior volume into which the first stem of the first poppet extends, further comprising a second cover removably coupled to the at least one second poppet assembly, wherein the second cover cooperates with the second housing of the at least one second poppet assembly to generally define a second interior volume into which the second stem of the second poppet extends.

8. The system of claim 7, wherein the at least one first poppet assembly comprises one or more first actuators disposed within the first interior volume generally defined by the first cover and the first housing, wherein the at least one second poppet assembly comprises one or more second actuators disposed within the second interior volume generally defined by the second cover and the second housing.

9. The system of claim 8, wherein the one or more first actuators comprise at least one of a first magnet or a first spring, wherein the one or more second actuators comprise at least one of a second magnet or a second spring.

10. The system of claim 7, comprising a first impact bushing disposed within the first interior volume generally defined by the first cover and the first housing and disposed between the first housing and a first component of the at least one first poppet assembly that moves during operation of the at least one first poppet assembly, further comprising a second impact bushing disposed within the second interior volume generally defined by the second cover and the second housing and disposed between the second housing and a second component of the at least one second poppet assembly that moves during operation of the at least one second poppet assembly.

11. The system of claim 10, wherein the first component comprises at least one of the first stem or a first actuator carrier coupled to the first stem, wherein the second component comprises at least one of the second stem or a second actuator carrier coupled to the second stem.

12. The system of claim 6, comprising a first impact bushing disposed between the first housing of the at least one first poppet assembly and the first poppet head, the first impact bushing having a first surface configured to cooperate with a first mating surface of the first poppet head to form a first seal therebetween when the first poppet is in a first closed position, further comprising a second impact bushing disposed between the second housing of the at least one second poppet assembly and the second poppet head, the second impact bushing having a second surface configured to cooperate with a second mating surface of the second poppet head to form a second seal therebetween when the second poppet is in a second closed position.

13. The system of claim 1, wherein each first poppet assembly of the plurality of first poppet assemblies includes no more than one first poppet, wherein each second poppet assembly of the plurality of second poppet assemblies includes no more than one second poppet.

14. A system comprising:

a compressor seat plate having a plurality of poppet valve receptacles, wherein the plurality of poppet valve receptacles comprises at least three receptacles; and a poppet valve assembly coupled to one of the plurality of poppet valve receptacles, wherein the poppet valve assembly comprises:

a poppet including a poppet head and a stem;

a housing configured to receive the stem of the poppet and to permit axial, reciprocal motion of the stem; and a cover threadingly coupled to the housing such that the cover and the housing generally define an internal cavity that encloses a biasing member;

wherein the poppet, the housing, and the cover are configured such that, when assembled, a portion of the stem extends through the housing into the internal cavity, while the poppet head remains outside the internal cavity.

15. The system of claim 14, wherein the housing is coupled to the compressor seat plate and such that the poppet head and the cover are disposed on opposite sides of the compressor seat plate.

16. The system of claim 14, wherein the housing is not configured to receive a plurality of poppets.

17. The system of claim 14, wherein the cover blocks a fluid from flowing through the cover.

18. A compressor comprising:

a frame;

a compression cylinder coupled to the frame, the compression cylinder configured to receive and discharge a fluid;

a plurality of mechanical components disposed in the frame and configured to facilitate compression of the fluid within a compression chamber of the compression cylinder; and at least one valve assembly disposed in the compression cylinder in fluid communication with the compression chamber, the at least one valve assembly comprising a seat plate having a plurality of fluid conduits, and a plurality of poppet assemblies coupled to the seat plate and generally extending from a side of the seat plate wherein each of the plurality of poppet assemblies couples to and are removed from the seat plate as a unit by threading and unthreading a housing to the seat plate.

19. The compressor of claim 18, wherein the at least one valve assembly comprises an inlet valve.

20. The compressor of claim 18, wherein a substantial portion of each poppet assembly of the plurality of poppet assemblies is positioned upstream with respect to the seat plate, and a poppet head of each poppet assembly of the plurality of poppet assemblies is positioned downstream with respect to the seat plate, such that, during operation of the compressor, the fluid flows first past the substantial portion and then past the poppet head.

21. The compressor of claim 18, wherein the at least one valve assembly is configured for operation independent of a guard plate.

* * * * *